United States Patent [19]

Colin

[11] 4,406,573

[45] Sep. 27, 1983

[54] DEVICE FOR LOADING AND COMPACTING RUBBISH IN A FIXED OR MOBILE RECEPTACLE

[76] Inventor: Marcel Colin, 19 rue de l'Eglise, 17140 Marsilly, France

[21] Appl. No.: 265,892

[22] Filed: May 20, 1981

[30] Foreign Application Priority Data

May 30, 1980 [FR] France ..... 80 12113

[51] Int. Cl.[3] ..... B65F 3/14; B30B 7/02

[52] U.S. Cl. ..... 414/525 R; 100/233; 414/679

[58] Field of Search ..... 100/232, 233, 234; 414/525 R, 679

[56] References Cited

U.S. PATENT DOCUMENTS

| | | | |
|---|---|---|---|
| 3,233,760 | 2/1966 | Herpich et al. | 414/525 |
| 3,455,471 | 7/1969 | Merther | 414/525 |
| 3,884,372 | 5/1975 | Kunii | 414/525 |
| 4,065,008 | 12/1977 | Ratledge | 414/525 |

FOREIGN PATENT DOCUMENTS

| | | | |
|---|---|---|---|
| 54-140314 | 10/1979 | Japan | 414/525 |

*Primary Examiner*—Robert B. Reeves
*Assistant Examiner*—David F. Hubbuch
*Attorney, Agent, or Firm*—Browdy and Neimark

[57] ABSTRACT

A device for loading and compacting rubbish in a receptacle includes a foldable billfold-type panel having upper and lower pivotably articulated sections and a sweeping element articulated to the end of the lower section and pivotably drivable, by actuators, in a trajectory about the lower section end. When the sections are disposed in a substantially folded orientation relative to one another the sweeping element is pivoted upwardly about the lower section end to permit rubbish to be loaded into a receiving portion of the receptacle. Thereafter, the sections are moved to a substantially co-planar orientation where the sweeping element is pivoted downwardly and about the lower section end to sweep the rubbish behind the sections. Finally, the sections are returned to the substantially folded orientation whereupon the rubbish behind the sections is compressed and compacted.

5 Claims, 13 Drawing Figures

18
16
17
11
22
19
20
24
7

18
15
16
22
19
20
11
24

18
15
16
19
22
20
17
24
7
11
12

18
16
20
19
22
3
11
24
7

3
18
13
14
16
17
9
4
20
11
24
5
7
2
3

DEVICE FOR LOADING AND COMPACTING RUBBISH IN A FIXED OR MOBILE RECEPTACLE

BACKGROUND OF THE INVENTION

This invention relates to a simple, sturdy device for loading and compacting, in a small volume, rubbish of all kinds, and particularly household rubbish and garbage, in a rubbish collection truck (lorry) or in any other fixed or mobile receptacle.

The various devices used until now are well-known. They are generally made up of a mobile scoop whose working face is flat, or a mobile toothed harrow, which dips into the rubbish which has been poured into a hopper and drives it into the collecting receptacle.

In the first arrangement mentioned, the scoop is driven by a mechanism with hydraulic actuators and connecting rods, guided by rollers or skids sliding in side rails or by other connecting rods. The scoop sweeps the rubbish into the hopper and pushes it against an ejector, over a large surface, without tearing it, and only compressing it enough when very substantial power is supplied. For this heavy and expensive mechanisms are required. Furthermore, the rubbish, when not compressed enough, tends to come back down into the hopper, swelling out again, since no retaining system prevents this.

In the second arrangement mentioned, the toothed harrow compresses the rubbish in a narrow passage, determined by the floor of the receptacle, and an ejector and a fixed toothed comb form a plug which prevents the rubbish from falling back. The rubbish is torn in the final compression phase and the mobile comb, continuing its continuous movement, scrapes off its teeth against the teeth of the fixed comb. This arrangement is not favorable for compressing so-called "bulky" rubbish or rubbish which can catch between the teeth and remain there causing blocking up which could bring about difficulties in emptying the unit. The transmission of the drive is either by pinion and chain trains, or by hydraulic actuators whose line of action is off-set and, therefore, synchronized. These mechanisms are heavy and expensive, and take up considerable space across the width of the truck which limits the loading bay to the same extent, a disadvantage whose harmful effects become greater as the truck becomes narrower and to the degree that the collection is done using containers. Furthermore, the continuous drive prevents performing loading operations in a space which is wide enough to provide shallow loading depths.

SUMMARY AND OBJECTS OF THE PRESENT INVENTION

The purpose of this invention is to avoid the disadvantages of the devices which are briefly described above, by using a powerful compacting system with the aid of a toothed comb fastened to a foldable "billfold" panel, whose two shutters, when in a closed portions determine a small volume in which the rubbish is compressed and held, while when in open position, the shutters gradually free the compressed rubbish is that very little can fall back because it is held by the following load.

In the present device, the rubbish is torn, providing a substantial compacting rate with a relatively low power applied. The very wide loading apparatus, easily extended or retracted depending upon the strokes chosen for the actuators which open the billfold panel, provides the following advantages:

low loading depth, 100 mm below the floor of the corresponding chamber, of approximately the diameter of the chassis tires;

large loading bay making it possible to mechanically collect by all types of containers;

large working volume of the hopper for receiving the rubbish thanks to its depth and its width (1.5 to 2 $m^3$);

wide angle for entry into the hopper, thus maximizing the space through which the rubbish can pass, whatever the nature and quantity.

It should be noted that, to load powdery products, the toothed comb can be replaced by a scoop.

Since the mechanisms are fastened by two spindles attached on either side of the gate uprights or the compartment uprights and stabilized by two connecting rods articulated on the gate uprights, a light structure is provided, whose side faces are relatively thin and push the center of gravity of the gate forward, providing two additional advantages:

grid load distribution on the truck axles;

short overhang (less than 2 m).

The system working cycle can be more or less fast according to the displacement of the hydraulic pump which supplies the actuators, and can be continuous or discontinuous, or even stop at any phase during the cycle.

BRIEF DESCRIPTION OF THE DRAWINGS

The objectives will appear upon reading the following detailed description with reference to the appended drawings which illustrate, but in no way limit, the many ways of setting up the invention.

On these drawings.

Figure 1:
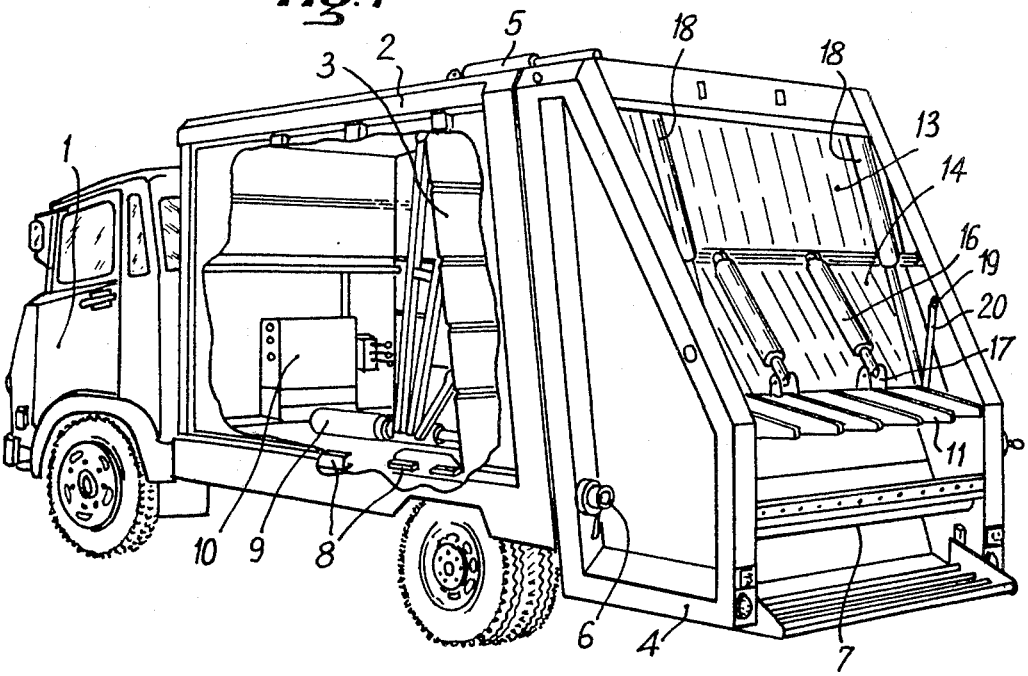
FIG. 1 is a view in perspective of a truck for collecting household rubbish and garbage, with emptying by ejector after lifting the gate, therefore, without tipping the compartment.

The household rubbish and garbage collection truck shown in FIG. 1, rearwardly of the driver's cab 1, has a receiving compartment 2 within which an ejector 3 can slide horizontally for unloading through the rear of the compartment. The compartment is fitted with a gate 4 which can be lifted around an upper horizontal spindle when driven by gate lift actuator 5. In collection position, gate 4 is locked in low closed position by locks 6, and this gate, at its base, has a loading hopper 7 into which the rubbish is pitched. For unloading, after lifting gate 4, ejector 3 is guided by the guide apparatus 8 and driven by an injection actuator 9; at 10, in front of ejector 3, there is an oil reservoir which drives the hydraulic actuators.

Figure 2:
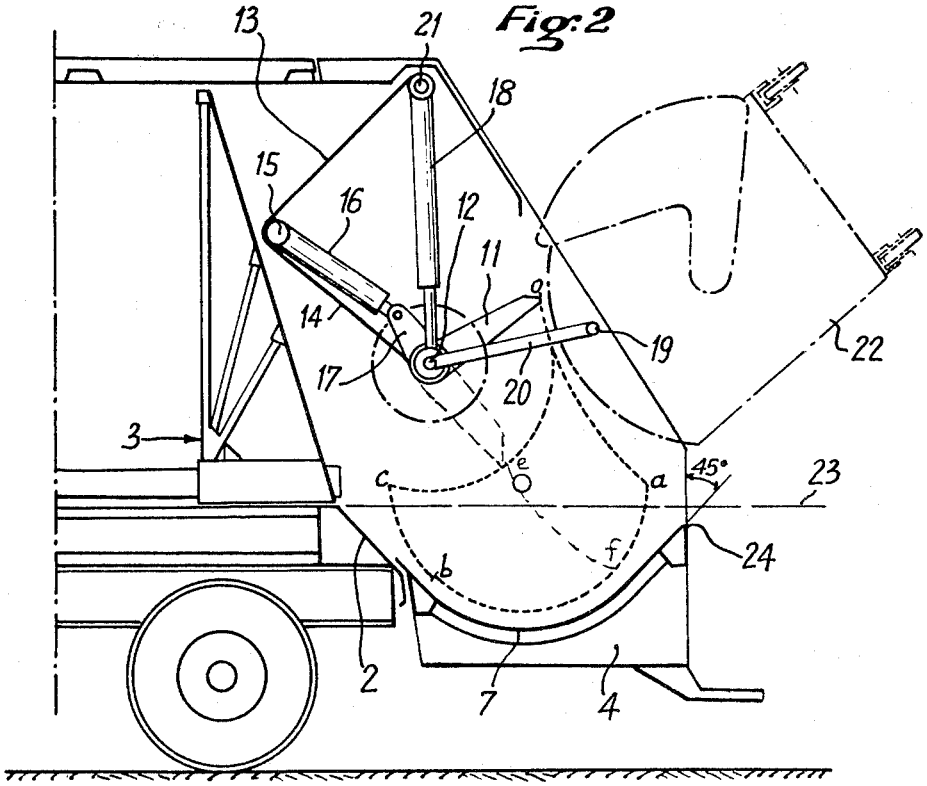
FIG. 2 shows the various loading cycle phases, in the case of the hooking up of the billfold panel in the gate structure, which is applicable to a low volume collection truck, while hooking it up in the compartment structure would be preferable in the case of a large volume, high truck.

In accordance with the invention, as seen in FIGS. 1 and 2 the crushing of the rubbish in hopper 7, then its delivery to compartment 2 and its compression are done by a comb 11 (or a scoop) which can pivot around a horizontal transversal spindle 12 at the base of a billfold type compression panel, which includes two superposed parts, 13 and 14, each articulating around the other by an intermediate transversal spindle 15. The pivoting of comb 11 is driven by the actuators 16 acting on the connecting rods 17 of comb 11 while the folding and opening of panels 13–14 are driven by actuators 18 mounted between the top and the bottom of panel 13–14. Horizontal spindle 12 is also linked to fixed lateral points 19 of the compartment gate by lateral stabilizing rods 20. In FIG. 2, at 21, is the horizontal transversal spindle for pivoting the top part of panel 13 and actuators 18 are mounted between spindles 21 and 12.

FIG. 2 shows panel 13–14 in the folded or closed position of the billfold structure, that is in the position to lift the panel so as to free the access to the hopper for tipping in a barrel of rubbish 22, tipped at an angle of 45° in the example shown. The compartment floor level is shown at 23 and, the rear edge of the loading hopper, shown at 24, can be at a distance, for example, of about 100 mm, below level 23 of the floor. The distance above the ground of hopper edge 24 is the loading height which can be very low.

Figure 3:
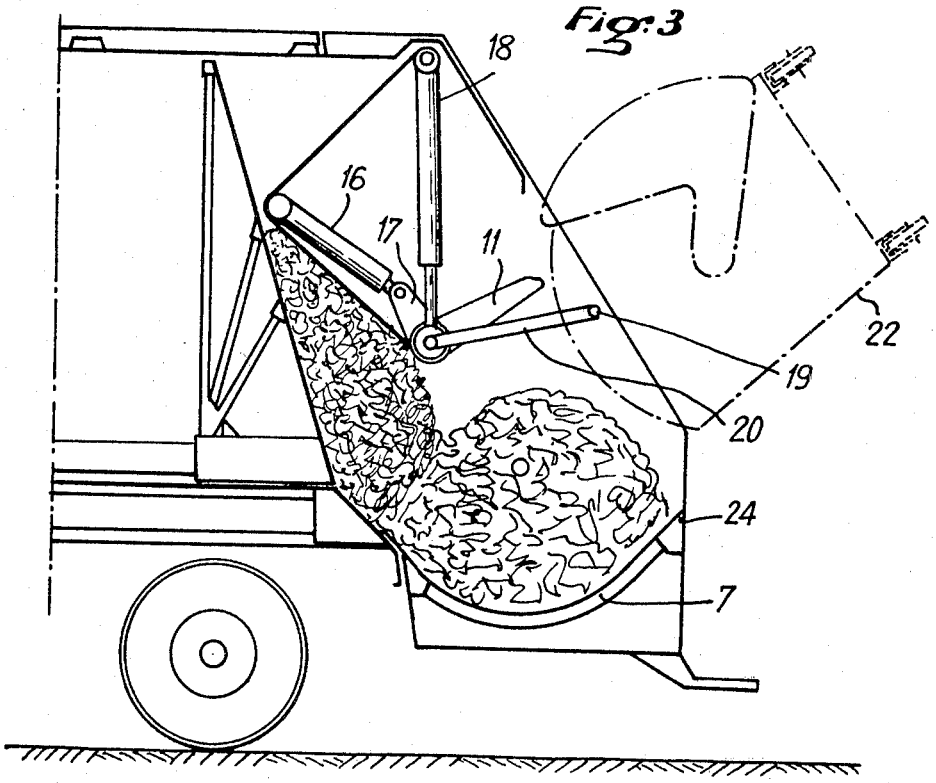
FIGS. 3, 4, 5 and 6 show the action of the mechanism during each phase of the cycle.
Figure 4:
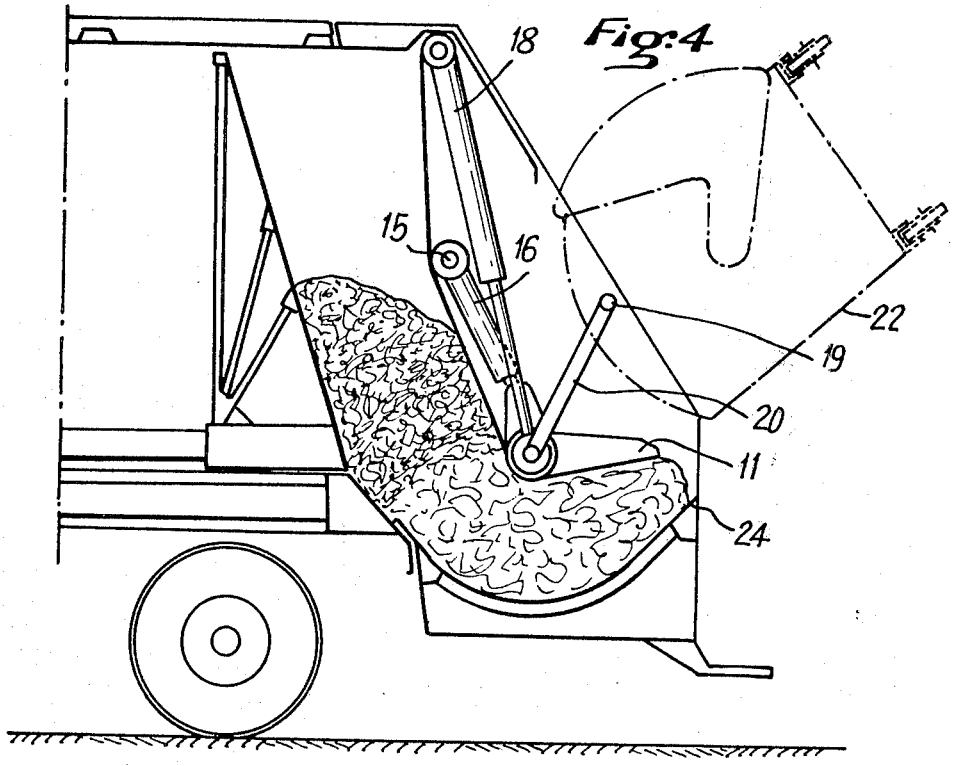
Figure 5:
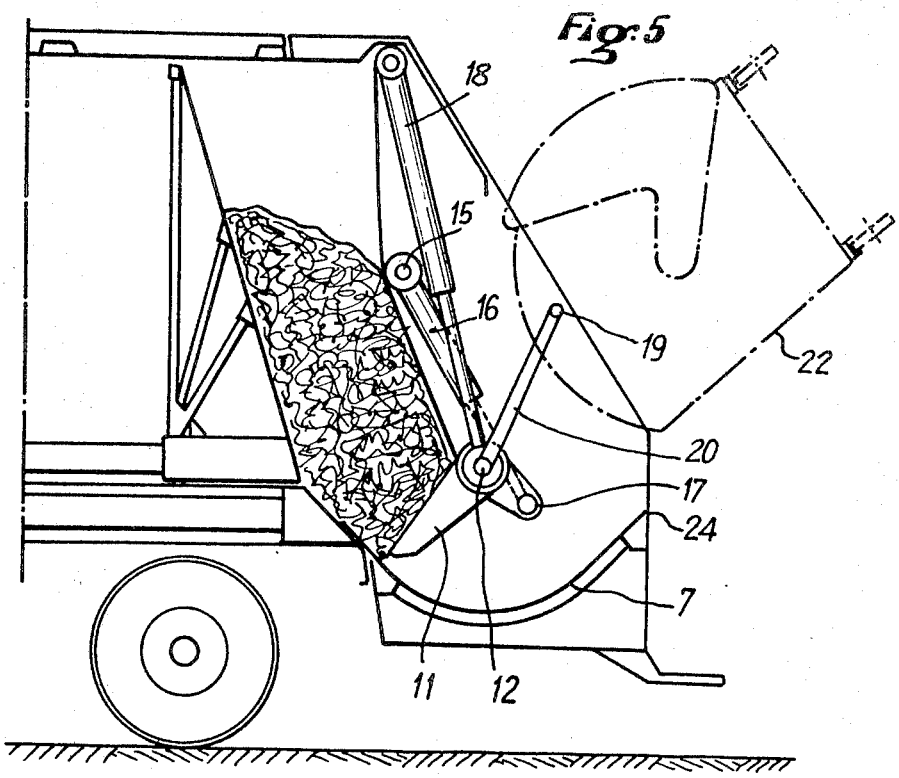
Figure 6:
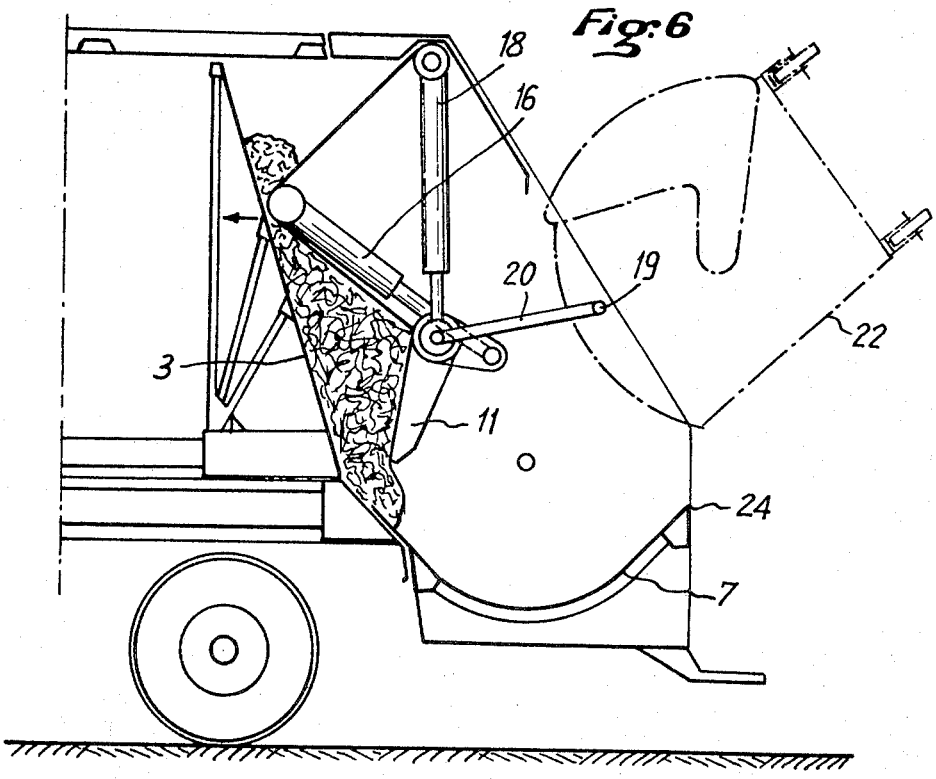
Figure 7:
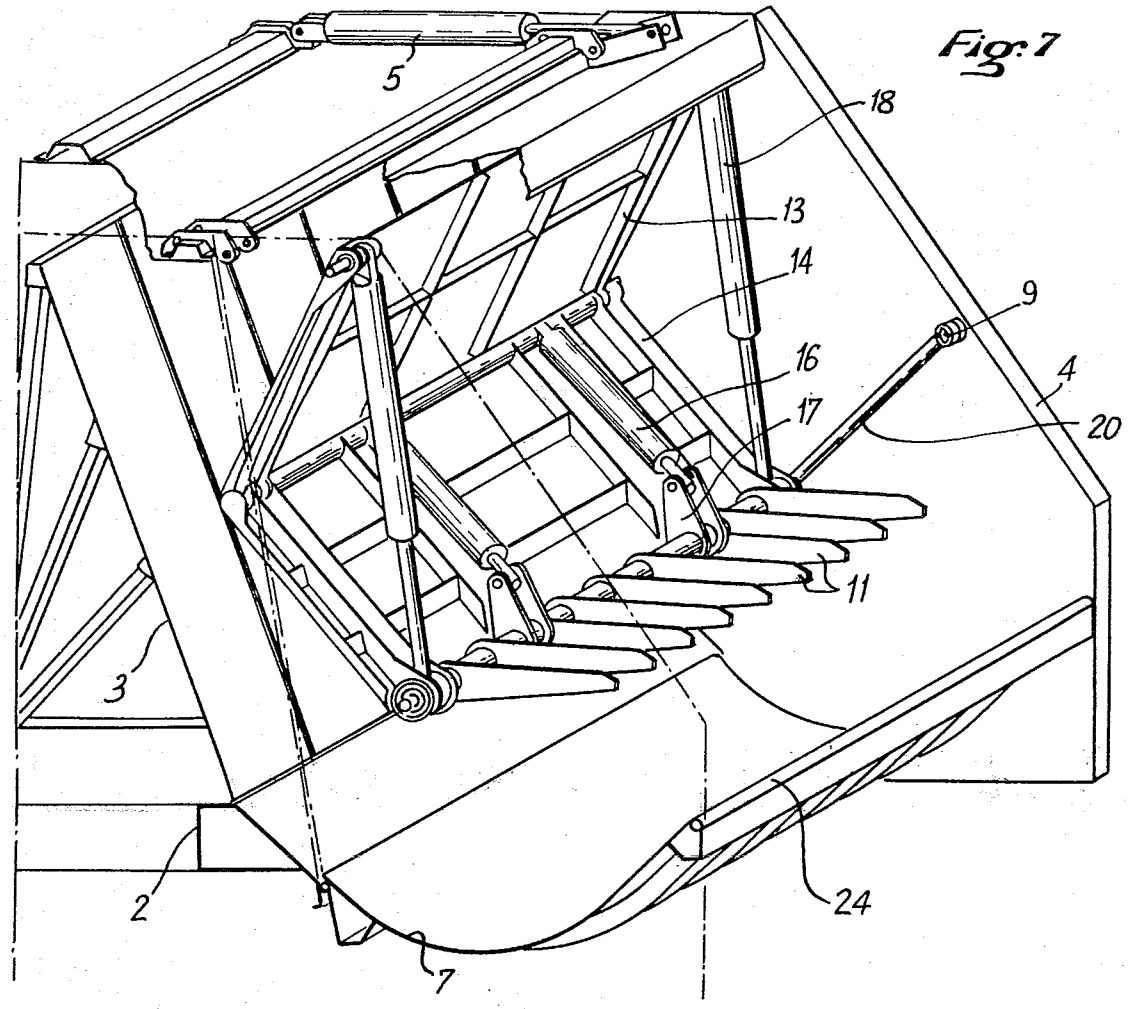
FIG. 7 is a rear view of the rubbish truck fitted with a loading device according to the invention.

On FIG. 2, there is a diagram showing the principle of the invention indicating the circuit followed by the end of comb 11 during a complete operating cycle including the return of the delivery apparatus to the delivery position. This circuit, beginning at point o, and returning there, includes the four parts oa-ab-bc-co corresponding respectively to the crushing of the rubbish by the descent of comb 11 and the opening out of the compression panel (FIG. 4), the sweeping of the rubbish into the hopper by rotating the comb under the effect of the actuators (FIG. 5), the compression of this rubbish by closing or lifting panel 14 and comb 11 (FIG. 6), and finally, the return to the loading position by bringing back comb 11 to the loading position shown in FIG. 3.

FIGS. 8 to 13 diagram examples of performance of the various elements of the loading apparatus and particularly, its articulations.

Figure 8:
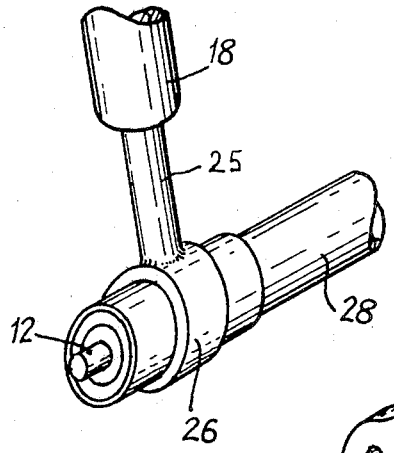
FIG. 8 is a detailed view of the connection between a panel actuator and the horizontal transverse spindle of the present invention.

FIG. 8 shows the effect of actuator 18 for driving the billfold structure, rod 25 of this actuator being integrated with a sleeve 26 around spindle 12.

Figure 9:
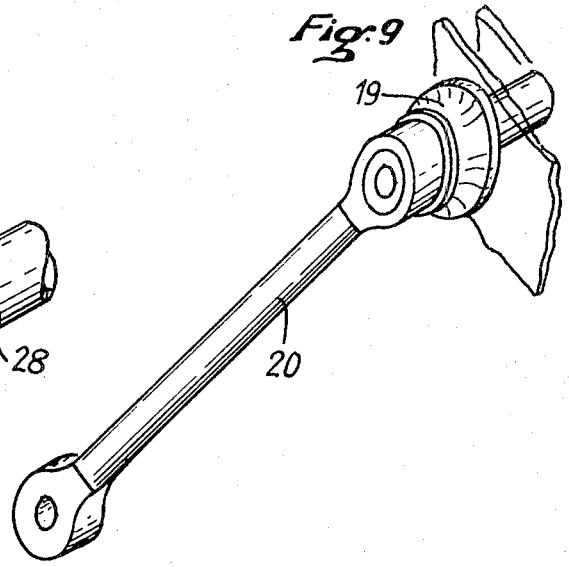
FIG. 9 shows the connection between a lateral stabilizing rod and the fixed lateral point on the gate.

FIG. 9 shows a mobile stabilizer 20 around a fixed lateral spindle 19.

Figure 10:
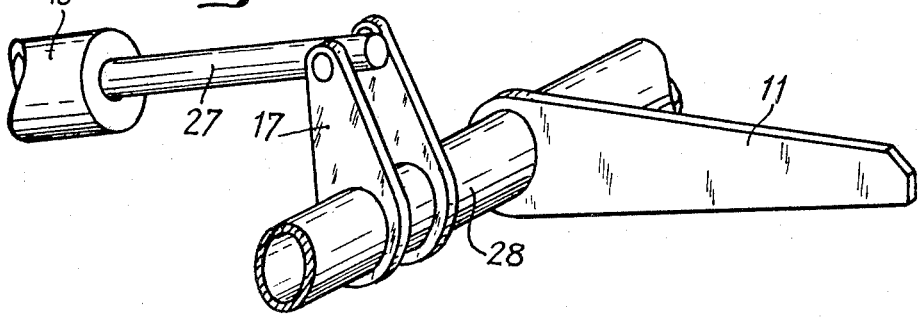
FIG. 10 shows the connection of the comb with a comb actuator.

FIG. 10 shows the connection of an actuator 16 having a rod 27 which drives connecting rods 17 integrated with the hollow shaft 28 which carries the comb 11.

Figure 11:
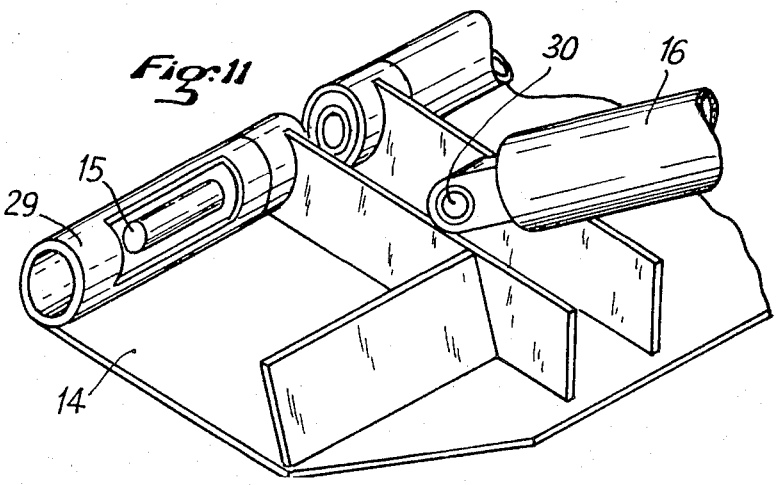
FIG. 11 is a detailed view of the connection between a comb actuator and the lower section of the billfold panel.

FIG. 11 shows the top of compression panel 14 which is integrated with hollow shaft 29 which can turn around spindle 15; it also shows upper articulation point 30 of a comb actuator 16.

Figures 12, 13:
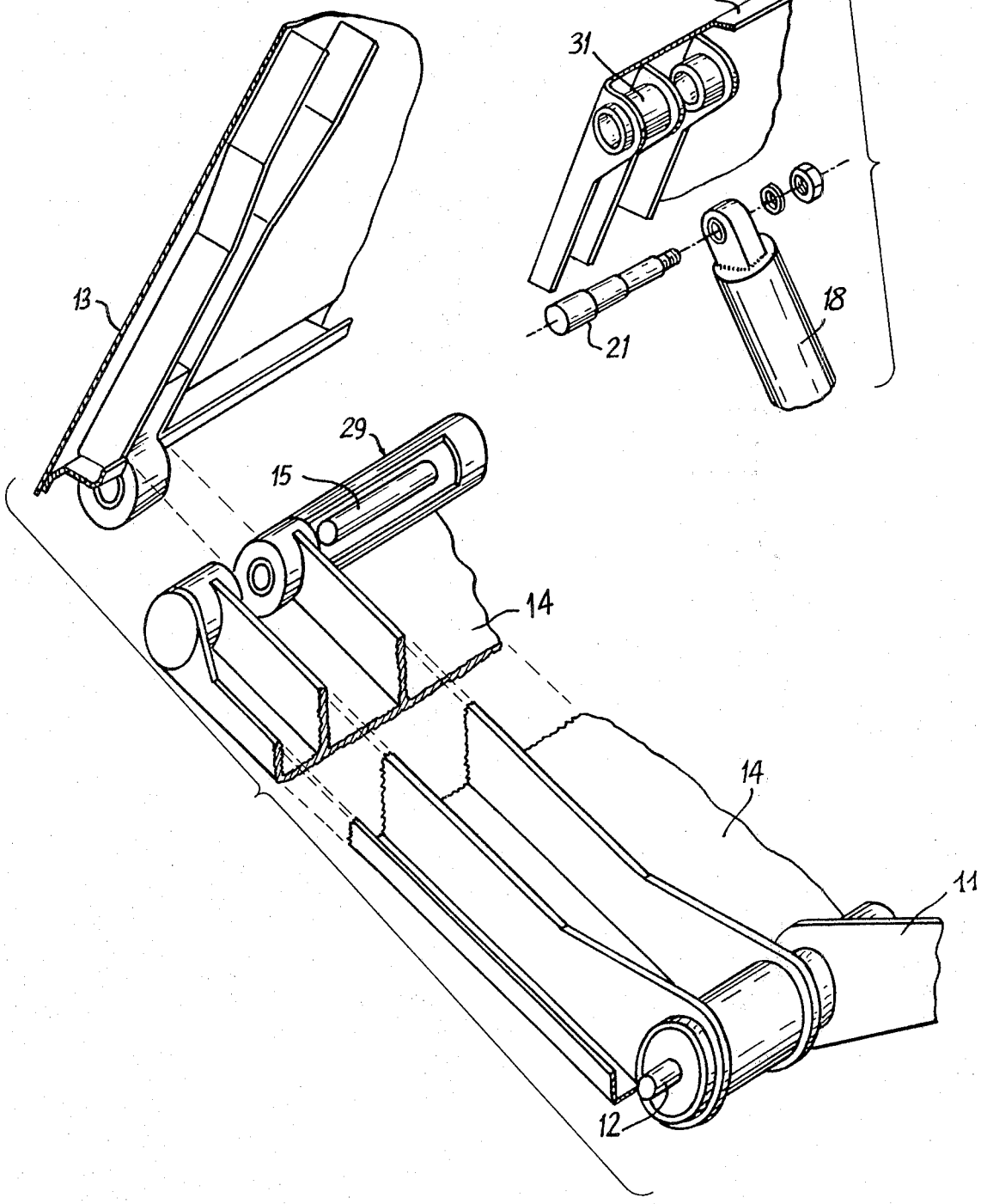
FIG. 12 is an exploded view of the connections between the planar sections of the billfold panel and the comb.
FIG. 13 shows the connection of a panel actuator with the upper section of the billfold panel.

FIG. 12, in three parts, exploded shows the articulation of the two panels 13 and 14 and the lower part of panel 14 holding comb 11.

Finally, FIG. 13 shows the fastening of an actuator 18 to the billboard structure 13–14 and the articulation of this actuator around upper spindle 21 upon which is also articulated hollow shaft 31 of the hook-up panel 13.

The embodiment of the invention which is particularly described above and shown in the appended drawing is in no way limited to the invention defined in the appended claims, and various modifications or additions can be made and are contemplated.

For example, in FIG. 2, the dotted line indicates a variant of the circuit or cycle accomplished by the end of comb 11. The end of the tooth of the comb here describes the curve oe-ef-fb-bc-ce. This operation is particularly advantageous and recommended when collecting bulky waste. In this case, comb 11 (or scoop) attacks the bulky object to tear it at the moment when it offers minimum resistance, and when the comb has its maximum power. Naturally, other cycles can be applied without diverging from the principle of the invention.

I claim:

1. Device for loading and compacting rubbish and garbage in a fixed or mobile receptacle or compartment having a receiving hopper, comprising:

a sweeping component in association with the receiving hopper, said hopper including a loading opening;

a billfold panel means for covering said loading opening and including (a) a first panel upon which said sweeping component is mounted and pivots;

(b) a second panel; and (c) a transverse spindle about which said first and second panels are pivotably articulated;

said billfold panel means being suspended from the top of the receptacle, said first and second panels acting to close said receptacle above said loading opening when said panels are disposed in a substantially planar orientation relative to one another, wherein sad sweeping component sweeps rubbish and garbage in said hopper into said receptacle, and said first and second panels acting to compress the rubbish and garbage thus swept into said receptacle when said panels are disposed in a folded position, about said spindle, relative to one another.

2. The device of claim 1, further comprising:

a liftable loading gate having lateral stabilizing connecting rods pivotably attached on opposite sides thereof, the base of said first panel being connected, at opposing sides, with said loading gate via said connecting rods, said connecting rods determining the trajectory of said first panel during opening out and folding back of said billfold panel means.

3. Device according to claim 1 or 2, wherein said sweeping component comprises a comb or scoop, and a horizontal transversal spindle affixed to said first panel (14) about which said comb or scoop pivots.

4. The device according to claim 1 or 2 including an ejector sliding longitudinally within said receptacle for unloading said rubbish and garbage therefrom wherein the rubbish and garbage loaded into the receiving hopper is compressed between the ejector and said billfold panel means.

5. The device of claim 1 or claim 2, further comprising:

first actuating means, interconnecting said transverse spindle with said sweeping component, for driving said sweeping component rotatably about one end of said first panel, and second actuating means, interconnecting said first and second panels, for driving the first and second panels into their opened out and folded back positions.

* * * * *